US008894819B2

(12) United States Patent
Sheerer et al.

(10) Patent No.: US 8,894,819 B2
(45) Date of Patent: Nov. 25, 2014

(54) IN-LINE DRAINER WITH SHAPED SCREEN SLOTS

(71) Applicant: Andritz Inc., Glens Falls, NY (US)

(72) Inventors: Jay Sheerer, Queensbury, NY (US); Jeffrey Lawrence Gazdik, Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 13/853,692

(22) Filed: Mar. 29, 2013

(65) Prior Publication Data

US 2013/0284390 A1 Oct. 31, 2013

Related U.S. Application Data

(60) Provisional application No. 61/638,246, filed on Apr. 25, 2012.

(51) Int. Cl.

| | |
|---|---|
| ***D21C 7/06*** | (2006.01) |
| ***D21D 5/16*** | (2006.01) |
| ***D21C 11/00*** | (2006.01) |
| ***D21C 7/14*** | (2006.01) |

(52) U.S. Cl.

CPC *D21C 11/00* (2013.01); *D21C 7/06* (2013.01); *D21C 7/14* (2013.01); *D21D 5/16* (2013.01)

USPC ..... 162/245; 162/55; 162/246; 210/767; 209/240; 209/243; 209/730

(58) Field of Classification Search

CPC ..... D21C 7/06; D21C 7/08; D21C 7/14; D21C 11/00; D21D 5/16; B01D 33/11; B01D 33/067; B04B 7/16

USPC ..... 162/232, 245–246, 251, 264, 380, 55; 210/370–371, 376, 397, 415, 455, 210/497.01, 498, 767; 209/240, 243, 725, 209/730

See application file for complete search history.

(56) References Cited

U.S. PATENT DOCUMENTS

| | | | | | |
|---|---|---|---|---|---|
| 3,713,541 | A | * | 1/1973 | Nelson | 210/415 |
| 4,309,284 | A | * | 1/1982 | Morimoto et al. | 209/273 |
| 4,885,090 | A | * | 12/1989 | Chupka et al. | 210/497.01 |
| 5,110,461 | A | * | 5/1992 | Abel | 210/158 |
| 5,380,434 | A | * | 1/1995 | Paschedag | 210/360.2 |
| 5,397,471 | A | * | 3/1995 | Rodebush et al. | 210/360.1 |
| 5,849,151 | A | * | 12/1998 | Marcoccia et al. | 162/42 |

(Continued)

FOREIGN PATENT DOCUMENTS

| | | | | |
|---|---|---|---|---|
| CA | 2436449 | A1 | * | 2/2005 |
| EP | 2607547 | A1 | * | 6/2013 |
| JP | 2008174894 | A | * | 7/2008 |
| JP | 2013032611 | A | * | 2/2013 |

*Primary Examiner* — Jose Fortuna

(74) *Attorney, Agent, or Firm* — Kerri Hochgesang; Robert Joseph Hornung

(57) ABSTRACT

An in-line drainer or liquid separator for draining liquid from a moving black liquor slurry stream having a screen basket mounted in the internal chamber of the in-line drainer. The screen basket includes slots to retain solid particles of the moving black liquor slurry stream within the black liquor slurry stream flow chamber and block the solid particles from entering the liquid collection chamber. The slots each have a curved corner edge adjacent a surface screen basket facing the black liquor slurry stream flow chamber.

16 Claims, 5 Drawing Sheets

(56) References Cited

U.S. PATENT DOCUMENTS

| | | | | |
|---|---|---|---|---|
| 6,039,841 | A * | 3/2000 | Hernesniemi | 162/251 |
| 6,129,816 | A * | 10/2000 | Sheerer et al. | 162/237 |
| 6,436,233 | B1 * | 8/2002 | Barrett et al. | 162/52 |
| 6,451,172 | B1 | 9/2002 | Barrett et al. | |
| 6,514,421 | B2 * | 2/2003 | Leung et al. | 210/781 |
| 7,125,472 | B2 * | 10/2006 | Baker | 162/251 |
| 7,168,570 | B2 * | 1/2007 | Frejborg | 209/283 |
| 7,422,657 | B2 * | 9/2008 | Gustavsson et al. | 162/52 |
| 7,799,173 | B2 * | 9/2010 | Sheerer et al. | 162/246 |
| 2002/0059991 | A1 * | 5/2002 | Barrett et al. | 162/17 |
| 2002/0148763 | A1 * | 10/2002 | Lutz et al. | 210/232 |
| 2003/0201213 | A1 * | 10/2003 | Bolles et al. | 209/725 |
| 2004/0007343 | A1 * | 1/2004 | Baker | 162/251 |
| 2008/0173415 | A1 | 7/2008 | Sheerer et al. | |
| 2013/0146547 | A1 * | 6/2013 | Sheerer et al. | 210/767 |
| 2013/0284390 | A1 * | 10/2013 | Sheerer et al. | 162/189 |
| 2014/0182802 | A1 * | 7/2014 | Bechard et al. | 162/232 |

* cited by examiner

IN-LINE DRAINER WITH SHAPED SCREEN SLOTS

CROSS RELATED APPLICATION

This application claims priority to U.S. Provisional Patent Application Ser. No. 61/638,246 filed Apr. 25, 2012 which is incorporated herein by reference.

BACKGROUND OF THE INVENTION

1. Technical Field

The invention relates to liquid separating devices for removing a stream of liquid from a black liquor slurry stream of liquid and solids (black liquor). The invention particularly relates to screen slots in an in-line drainer for separating a stream of excess liquor from the stream of black liquor, which comprises liquid typically containing at least some wood chips or fine wood particles in a pulping system.

2. Related Art

In-line drainers for pulping systems, such as disclosed in U.S. Pat. No. 6,451,172, are typically used in the chip feed of a pulping system. A common use for in-line drainers is to return strained liquid from a black liquor slurry stream to a slurry of wood chips and liquor flowing through a high pressure transfer device to a pulping vessel, such as a continuous digester vessel. The in-line drainer removes some of the liquid in the black liquor slurry stream from the low pressure outlet of a high pressure transfer device. The strained liquid removed from the black liquor slurry stream by the in-line drainer may be reused in the pulping system. The recirculated liquid, which is a mixture of wood chips and remaining liquor flowing from the in-line drainer, flows back into the chip flow from a chip bin and moves to the high pressure feeder.

A difficulty with in-line drainers occurs in the removal of the liquid from the black liquor slurry stream by screening. The screening process associated with separating some of the strained liquid from the black liquor slurry stream retains wood chips, wood fines, and wood pins within the liquor flowing through the in-line drainer (which liquid will become recirculated liquid). Screening is typically performed with a cylindrical basket in the in-line drainer. The walls of the basket include slots or apertures so narrow that wood fines and pins cannot pass through them. Conventional screen baskets are fashioned from steel bars oriented in a parallel, horizontal, or inclined fashion at an angle relative to the direction of flow of the black liquor slurry stream so that the liquor passes through the slots while retaining wood particles within the in-line drainer so the wood particles can be removed from the in-line drainer in the recirculated liquid stream. Conventional cylindrical screen baskets are formed of a solid sheet of material with slots through the sheet, as shown in U.S. Pat. No. 6,451,172.

The black liquor slurry stream passing through an in-line drainer typically has a liquid to wood ratio (on a volume basis) of greater than 5 to 1 (meaning at least 5 parts liquid to 1 part solids) resulting in a low concentration of solids in the stream to the screen basket within the in-line drainer. The black liquor slurry stream flowing through the screen basket moves at a high velocity, such as 10 feet per second. As a result of the low solids concentration and high velocity through the screen basket, the solid material, e.g., wood chips, pins, and fines, easily aligns parallel to the slots and passes through the slots or becomes lodged in the slots of the screen basket.

To prevent solids from passing through or becoming lodged in the slots, conventional in-line drainers have helical baffles or helical flights that impart a helical movement to the black liquor slurry stream flowing through the screen basket. The helical movement of the black liquor slurry stream causes the solids to move in a helical path through the screen basket and not to become lodged parallel to the slots.

Another approach to preventing clogging and to encourage the passage of solids through the slots in the screen basket is to align the slots of the screen basket obliquely to the axial direction of elongation of the in-line drainer, and thus obliquely to the direction of flow through the screen basket. This other approach does not suffer a pressure loss in the black liquor slurry stream that is commonly found when using helical baffles and flights. The angle of the screen basket slots relative to the direction of black liquor slurry stream flow through the screen basket ranges from about 0 degrees (perpendicular) to 90 degrees.

Helical baffles and flights, and slots oblique to the flow of the black liquor slurry stream have not completely eliminated the problem of slots becoming clogged with solids, especially with wood fines and pins. Such clogging is a particular problem occurring when the slots are created by cutting into screen baskets formed from metal plates. There remains a long felt need for screen baskets having slots that are less prone to becoming clogged with solids, such as wood chips, fines, and pins. It is to this need and others that the present disclosure is directed.

The terms chips, fines, and pins herein generally refer to comminuted cellulosic fibrous material may such as wood chips, sawdust, grasses such as straw or kenaf, and agricultural waste such as bagasse and recycled paper. The in-line drainers disclosed herein are applicable to liquid separators for feed systems of both continuous and batch digesters, and also applicable to feeding several continuous digesters or one or more discontinuous or batch digesters.

BRIEF SUMMARY OF THE INVENTION

An embodiment of a screen basket has been conceived having a novel screen basket slot design comprising slanted slots with curved inlet edges. The screen basket can be created from a metal plate joined at opposite side edges to form the cylinder. The curved inlet edges reduce the tendency of solid material to be caught by the slot as the material flows through the screen basket. The sharp edges of conventional sharp-edged slots, such as slots having a right-angled corner, have a tendency to catch solid material that ideally should flow past the slots and through the screen basket.

The slots having curved inlet slot edges are adjacent an inside surface of the screen plate. The curved inlet slot edges may be rounded, sloped, chamfered, or inclined. For example, inlets can have a generous radius of curvature equal to one third to two thirds the thickness of the plate. The curved inlets can be only on the lower side surface of a slot or on the upper and lower side surfaces of the slot.

Another embodiment of a screen basket has been conceived for a liquid separating device for use in a feed system of a process to produce pulp out of comminuted cellulosic material (such as wood chips). The screen basket comprises a cylindrical housing including an inlet for a black liquor slurry stream of solids and liquid at or adjacent to a first end of the cylindrical housing. The screen basket also has an outlet for the recirculated liquid at or adjacent to an opposite end, an outlet for strained liquid at or adjacent to the first end for the recirculated liquid, and an inside surface. A cylindrical screen basket assembly is centrally mounted in the cylindrical housing, and includes an outside cylindrical surface. An annular cavity is between the outside surface of the screen basket and the inside surface of the cylindrical housing, and an outlet for separated or strained liquid is in fluid communication with the annular cavity. The cylindrical screen basket is made from a plate formed into a cylinder with a straight joint connecting opposite side edges of the plate, and rows or columns of slots extending through the plate. Each slot has a curved inlet corner edge adjacent to an inside surface of the plate and is oblique to a longitudinal axis of the basket. The curved corner inlet slot edge can be rounded, chamfered, sloped, and/or inclined. The curved inlet corner edges of the slots can have a radius of curvature in a range of one third to two thirds of the thickness of the plate. The curved corner edges of the slots can be at only one of a lower edge or upper edge of each slot, or at both edges of the slots.

The axis of each slot extending through the cylindrical plate of the screen basket can be oblique to a respective radial line from an axis of the screen basket such that the inlet of each slot at the inside surface of the plate of the screen basket is downstream in the direction of black liquor slurry stream flow to the outlet of the slot on the outside surface of the plate. In particular, the axis of each slot may be at an oblique angle between 5 degrees to 45 degrees, or 5 degrees to 30 degrees, or 5 degrees to 15 degrees. The orientation of the length of each slot may be oblique to the axis of the screen basket such as at an angle of 1 degree to 75 degrees, or 30 degrees to 60 degrees, 40 degrees to 50 degrees or 45 degrees. In each row of slots in the screen basket, the slots can be uniform in shape, dimensions, height, and orientation. The shape, dimensions, height, and orientation can vary from row to row.

An embodiment of a method has been conceived for draining liquid from a black liquor slurry stream with a liquid separator, known as an in-line drainer, having a cylindrical screen basket formed from a metallic plate with slots cut into the plate. An embodiment of the method comprises the following steps: feeding a black liquor slurry stream of liquid and solid material, such as wood chips, pins, and fines, into an annular region of a liquid separator between a cylindrical housing of the separator and a cylindrical screen basket; separating a portion of the liquid from the black liquor slurry stream of cellulosic material as the black liquor slurry stream passes through the slots in the screen basket, where substantially all solids in the black liquor slurry stream cannot pass through the slots; the solids flowing over curved inlet corner edges of the slots, where the edges are adjacent to a surface of the screen basket plate adjacent to the annular region and facing a flow of black liquor; the portion of the liquid being discharged as relatively clean liquid, and the black liquor slurry stream without the separated portion of the liquid is discharged from the liquid separator.

An embodiment of a liquid separator has been conceived for draining liquid from the liquid separator of a feed system to produce pulp comminuted cellulosic material. The liquid separator comprises a rolled plate formed into a cylindrical screen basket and columns or rows of slots formed in the plate and oriented horizontally. Each slot has a curved inlet corner edge adjacent an inside surface of the plate, and each slot is oblique to a vertical axis of the basket. A single welded joint extends vertically between abutting edges of the plate, and a conveyor screw located within the interior of the cylindrical screen basket. The curved corner inlet slot edge may be rounded, chamfered, sloped and/or inclined. The curved inlet corner edge has a radius of curvature in a range of one third to two thirds of the thickness of the plate. The curved corner edge may be only at one of a lower edge or upper edge of each slot, or on both edges.

Another embodiment of a liquid separator has been conceived for draining liquid from the liquid separator of a feed system to produce pulp comminuted cellulosic material, which comprises a rolled plate formed into a cylindrical screen basket, and columns or rows of slots formed in the plate and oriented vertically, where each slot has a curved inlet corner edge adjacent to an inside surface of the plate, and each slot is oblique to a vertical axis of the basket. A single welded joint extends vertically between abutting edges of the plate, and a conveyor screw is interior to the cylindrical screen basket. The curved corner inlet slot edge may be rounded, chamfered, sloped and/or inclined. The curved inlet corner edge may have a radius of curvature in a range of one third to two thirds a thickness of the plate. The curved corner edge may be only at one of a lower edge or upper edge of each slot, or on both edges of the slots.

DETAILED DESCRIPTION OF THE DRAWINGS

Figure 1:
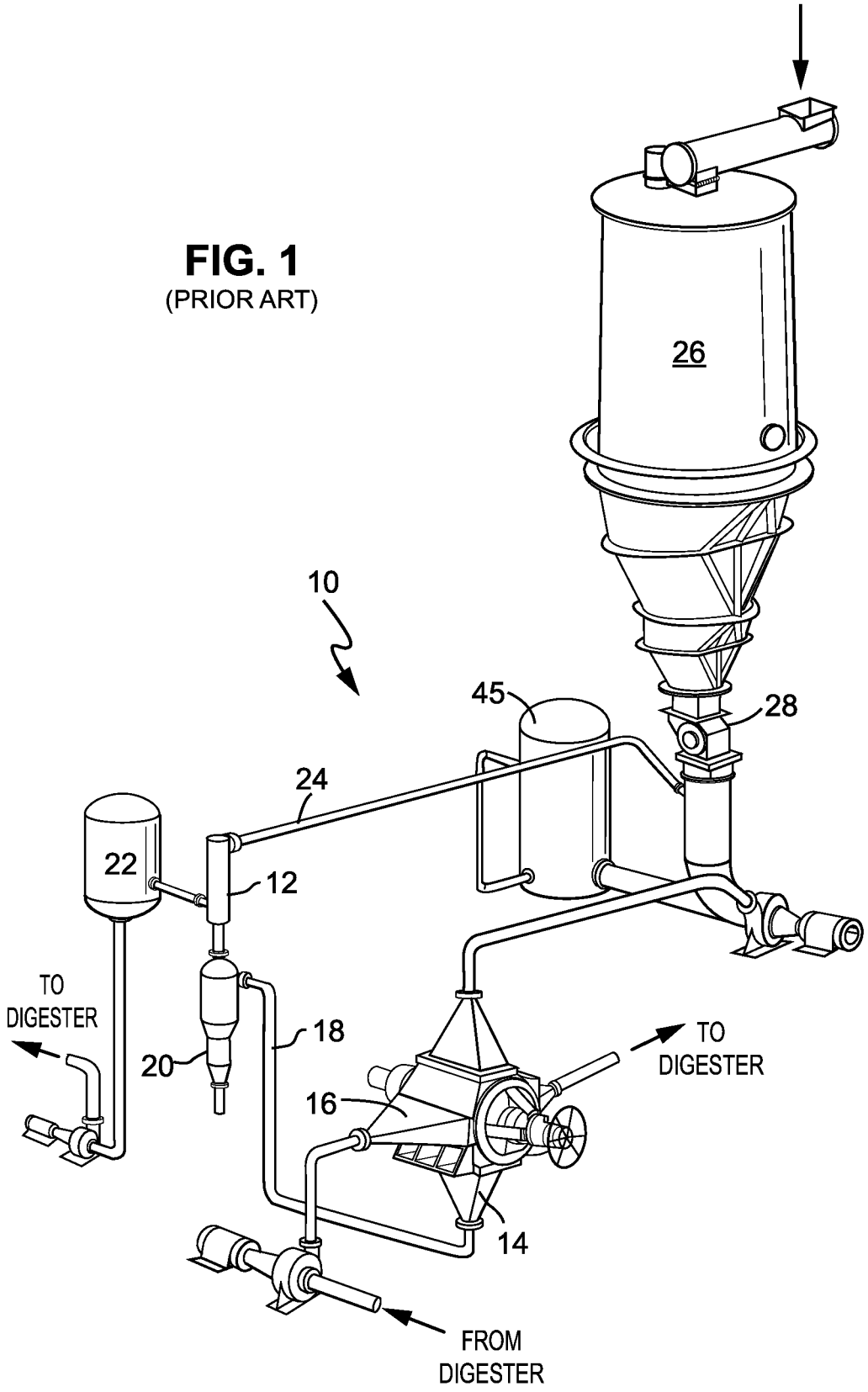
FIG. 1 (PRIOR ART)
FIG. 1 is a schematic illustration of a continuous digester system employing a conventional chip feed system that includes an in-line drainer.

FIG. 1 is a schematic illustration of a chip feed system 10 for a conventional continuous digester plant. The chip feed system 10 includes an in-line drainer 12. The in-line drainer 12 receives a black liquor slurry stream comprised of liquor and solids, e.g., wood chips, fines, and pins, discharged from a low pressure liquor outlet 14 from a high pressure transfer device 16 (in this case, a high pressure feeder). The black liquor slurry stream has a high ratio of liquor to solids because a screen at the liquor outlet prevents most solids, especially chips, from being discharged from that low pressure liquor outlet 14. The black liquor slurry stream flows through high pressure feeder low pressure outlet conduit 18 and into a sand separator 20, e.g., a centrifugal sand separator, which has a lower discharge opening for heavy solids, e.g. sand and fine particles, and an upper discharge opening for the black liquor slurry stream of liquor and lighter solids, e.g., chips, fines, and pins. The black liquor slurry stream flows to the in-line drainer 12 which removes a portion of the liquid from the black liquor slurry stream and directs the removed liquid (strained liquid) to a storage tank 22 for use in the digesting system. The black liquor slurry stream with the remaining liquid flows through recirculated liquid outlet conduit 24 and enters the flow of recirculated liquid comprised of chips and liquid moving from a chip bin 26, through a chip tube 28 and to the high pressure transfer device 16.

Adding recirculated liquid from the in-line drainer 12 to the chips flowing from the chip bin 26 increases the ratio of liquor to chips in the slurry in the chip tube 28 and entering the high pressure transfer device 16. The in-line drainer 12 is in a circulation loop which continually reuses liquor in the transport of chips from the chip bin 26 to the high pressure transfer device 16. The in-line drainer 12 also moves wood solids that passed through the screens at the low pressure liquor outlet 14 of the high pressure transfer device 16 back into the slurry of wood chips being transferred through the high pressure transfer device 16 to the digester vessel.

Figure 2:
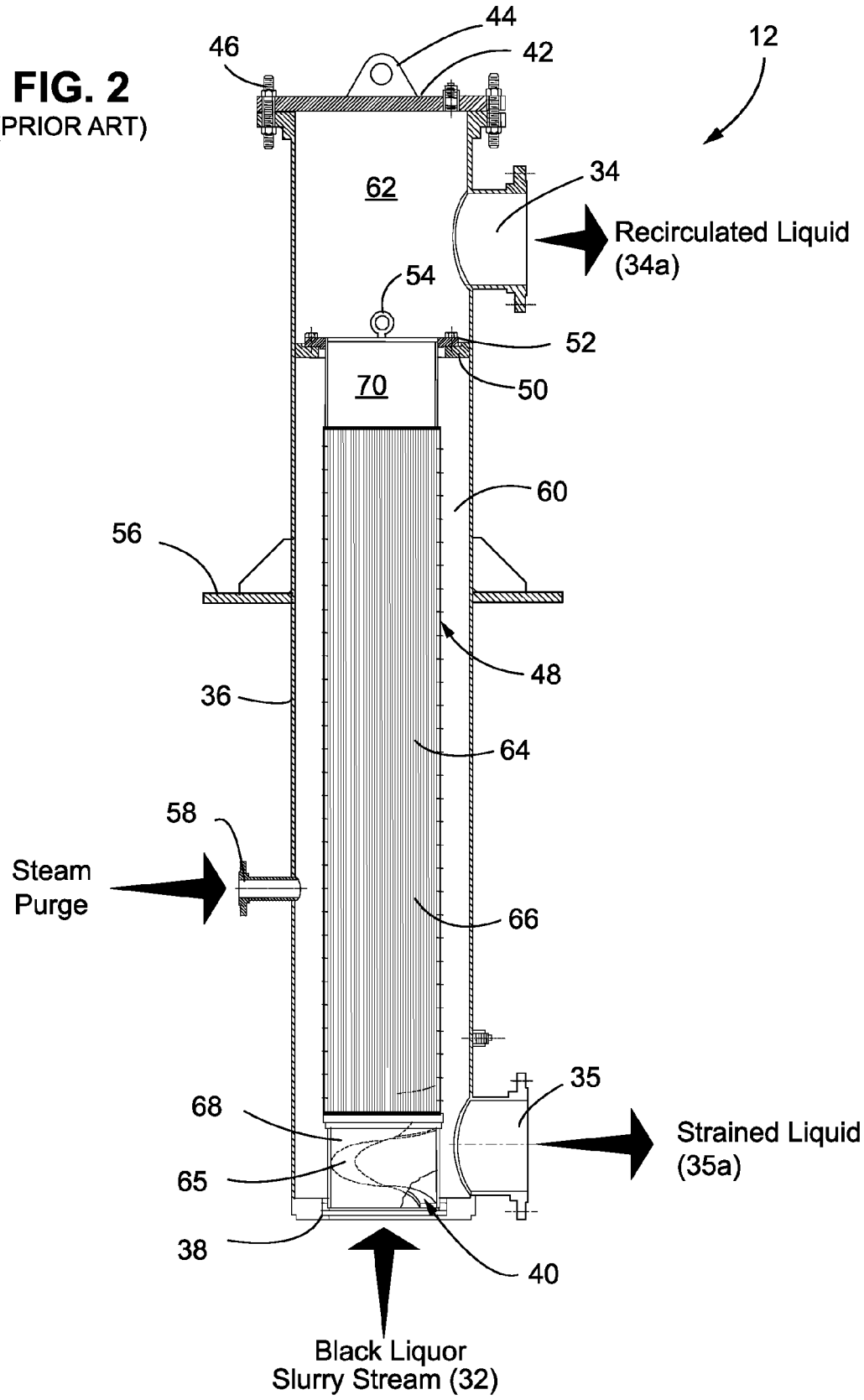
FIG. 2 (PRIOR ART)
FIG. 2 is a cross-sectional view of a conventional in-line drainer.

FIG. 2 is a cross-sectional view of a conventional in-line drainer 12 having a black liquor slurry stream 32 for a particulate-bearing liquid, to be strained, a strained liquid outlet 35 for liquid that has been passed or strained through the cylindrical screen basket 48 of the in-line drainer 12, and a recirculated liquid outlet 34 for the liquid removed from the black liquor slurry stream 32. The in-line drainer 12 includes a cylindrical housing 36 having a lower end cover plate 38 having an inlet opening 40 and an outlet end having upper end cover plate 42. The upper end cover plate 42 typically includes a lifting eye 44 and appropriate top mounting hardware 46, for example, threaded studs and nuts. A cylindrical screen basket 48 which is typically coaxial with the cylindrical housing 36, is mounted within the cylindrical housing 36. The cylindrical screen basket 48 and cylindrical housing 36 are typically oriented vertically. The upper end of the cylindrical screen basket 48 has a lip seated on an annular mounting flange 50 on the cylindrical housing 36 and appropriate internal mounting hardware 52 such as threaded screws. The lower end of the cylindrical screen basket 48 fits snugly in a machined surface of the inlet opening 40 of the lower end cover plate 38.

The cylindrical screen basket 48 may also include a basket lifting eye 54 for removing the cylindrical screen basket 48 for replacement or servicing. The cylindrical housing 36 typically includes a gusseted mounting flange 56 for installing the in-line drainer 12 in the chip feed system 10. A steam purge inlet 58 allows steam to be injected into the cylindrical housing 36 for periodic steam cleaning of the in-line drainer 12 and, particularly, the cylindrical screen basket 48.

The cylindrical screen basket 48 is positioned in the cylindrical housing 36 so that an annular cavity 60 is created between the outside surface of the cylindrical screen basket 48 and the inside surface of the cylindrical housing 36. The annular cavity 60 receives the black liquor slurry stream passing through slots in the cylindrical screen basket 48 and flowing to the strained liquid outlet 35. A black liquor slurry stream flow path through the in-line drainer 12 extends from the inlet opening 40 where the black liquor slurry stream 32 enters, through the hollow center of the cylindrical screen basket 48 and to an upper chamber 62 in the cylindrical housing 36. The upper chamber 62 is separated from the annular cavity 60 such that the strained liquid 35*a* in the annular cavity 60 does not mix with the recirculated liquid 34*a* in the upper chamber 62. From the upper chamber 62, the recirculated liquid 34*a* flows through the recirculated liquid outlet 34. A helical baffle 65 imparts a helical flow to the black liquor slurry stream 32 moving up into the cylindrical screen basket 48.

Though the centerline of the recirculated liquid outlet 34 is positioned at a right angle to the centerline of the cylindrical housing 36, the recirculated liquid outlet 34 may also positioned in the upper cover plate 42 so that its centerline is essentially collinear with the centerline of the cylindrical housing 36. The recirculated liquid outlet 34 collinear with the centerline of the cylindrical housing 36 and the black liquor slurry stream flow may be used for black liquor slurry streams having relatively low liquor to solids ratios. In such black liquor slurry streams, abrupt changes in flow direction, such as turning ninety degrees to the recirculated liquid outlet 34, may result in undesirable flow restrictions and stagnation of solids within the in-line drainer 12. For black liquor slurry streams having relatively high liquor to solids ratios, such as in a black liquor slurry stream from a low pressure outlet of a high pressure transfer device 16 or high pressure feeder, an abrupt change in flow direction is often acceptable and does not result in stagnations of solids.

Conventional cylindrical screen baskets 48 may be fabricated from a series of evenly-spaced vertical bars 64 so that a straining surface is provided having a series of vertical slots 66 between the bars 64. The cylindrical screen basket 48 also typically includes lower unperforated cylindrical section 68 and upper unperforated cylindrical section 70 at each end of the cylindrical screen basket 48.

A pressurized black liquor slurry stream 32, such as a stream of liquor and wood chips, pins, or fines, enters the in-line drainer 12 through the inlet opening 40 of the in-line drainer 12. The black liquor slurry stream 32 may have a pressure ranging from about 0 to about 5 bar gage, or about 0 to about 30 bar gage. The design of the cylindrical housing 36 and cylindrical screen basket 48 will vary depending, among other things, upon this pressure. The helical baffle 65 imparts a tangential velocity component to the black liquor slurry stream 32 so that the flow through the cylindrical screen basket 48 is somewhat helical and oblique to the orientation of the vertical slots 66 between the vertical bars 64. As the black liquor slurry stream 32 passes through the cylindrical screen basket 48, some liquid from the black liquor slurry stream 32 passes through the vertical slots 66, collects in annular cavity 60, and is discharged from of the strained liquid outlet 35. The chips, fines, pins, and other substantial solids material are too large to pass through the slots 66 and remain within the cylindrical screen basket 48. The black liquor slurry stream 32, without the removed liquor, flows to the upper chamber 62 and is discharged from the recirculated liquid outlet 34.

In addition to being formed from parallel bars or wires, such as shown in FIG. 2, cylindrical screen baskets 48 are also conventionally formed from plates, e.g., stainless steel plates. The plates are shaped into a cylinder such that the sides of the plates are joined along a vertical joint line. A weld may extend along the joint line to hold the plate in a cylindrical shape and provide a seal between the side edges of the plate. The vertical slots 66 in the plate may be formed by water-jet cutting, laser cutting, electrical discharge milling (EDM), drilling, or other conventional methods of producing apertures or narrow slots in plates. The cylindrical housing 36 of the in-line drainer 12 and the cylindrical screen basket 48 are typically metallic, for example, steel, steel-based alloy, stainless steel, aluminum, titanium or any other commercially available metal, but may also be manufactured from a high-performance plastic or composite material.

Figure 3:
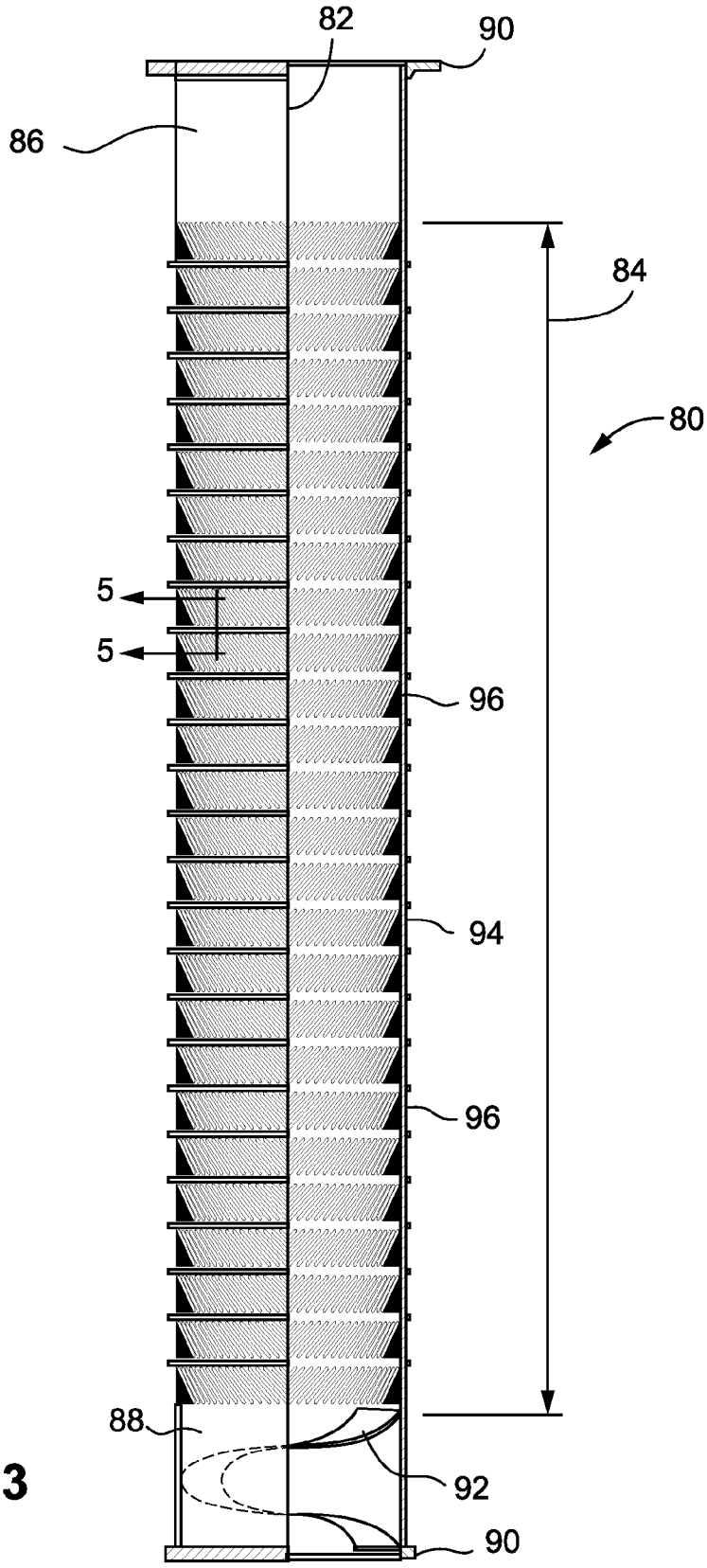
FIG. 3 is a side view of a screen basket for the in-line drainer, showing the right side of the screen basket in cross-section.

FIG. 3 is a side view of a screen basket 80 according to an embodiment of the invention. The left side of FIG. 3 shows a side view of the screen basket 80, and the right side shows a cross-sectional view to expose the interior surface of the screen basket 80. The screen basket 80 has a vertical axis 82. A vast majority, e.g., 80 to 90 percent, of the length of the screen basket 80 is covered by a pattern 84 of slots. An upper region 86 and lower region 88 are solid and slot-free. These regions provide structural support for the screen basket 80 and include the mounting flanges 90 at the ends of screen basket 80. The mounting flanges 90 may be metal rings that hold the top and bottom of the screen plate in a cylindrical shape and provide a connection to the cylindrical housing of the in-line drainer. The lower region 88 may house an optional helical flight 92 upstream of the inlet to the pattern 84 of slots.

The screen basket 80 may be a metal plate formed into a cylindrical shell with a welded vertical joint between abutting side edges of the plate. The screen basket 80 may be formed of another material suitable for use in a treatment vessel which typically houses an environment having acidic and alkaline chemicals.

The screen basket 80 may have a diameter of 10 to 36 inches (0.25 meter to 1.0 meter) and a vertical length of 48 to 120 inches (1.2 meter to 3 meter). These dimensions are exemplary. The screen basket 80 may have a vertical orientation and be coaxial to a cylindrical housing of the in-line drainer. The screen basket 80 may be included in an otherwise conventional in-line drainer 12 such as shown in FIG. 2.

Shaped slots 94 in the screen basket 80 may be uniformly shaped in length and width. The shaped slots 94 may be arranged in rows 96 on the screen basket 80. Each shaped slot 94 may have, for example, a length of 2 to 14 inches (50 mm to 360 mm), such as 110 mm. The vertical height of each row 96 may be 2 to 10 inches (50 mm to 250 mm). The number of shaped slots 94 in each row 96 is dependent on the circumference of the screen basket 80. The number of shaped slots 94 in each row 96 and the dimensions, e.g., vertical height, of each row 96 may be uniform in the screen basket 80 or vary from row to row. Within any row 96, the slot sizes (slot width, relief angle, and diagonal angle relative to the horizontal) may remain constant from slot to slot. The slot size may also vary from row to row. The number of rows 96 may depend on the desired open area in the screen basket 80 to allow for the desired flow of liquor extracted from the black liquor slurry stream (not shown in FIG. 3) entering the in-line drainer.

The shaped slots 94 extend through the plate of the screen basket 80 and are sized to allow liquid to pass and block solid material such as wood chips, fines, and pins. The shaped slots 94 may be slanted with respect to vertical and horizontal orientations. The shaped slots 94 are arranged in rows 96 that may be horizontal rows extending completely around the cylinder of the screen basket 80.

Figure 4:
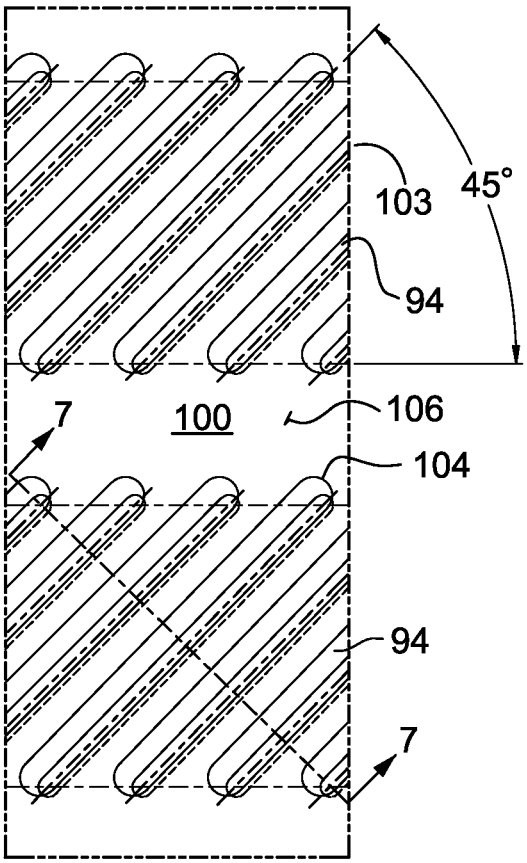
FIGS. 4, 5, and 6 show, respectively, an outer surface, cross section, and interior surface of a portion of the screen basket.
Figure 5:
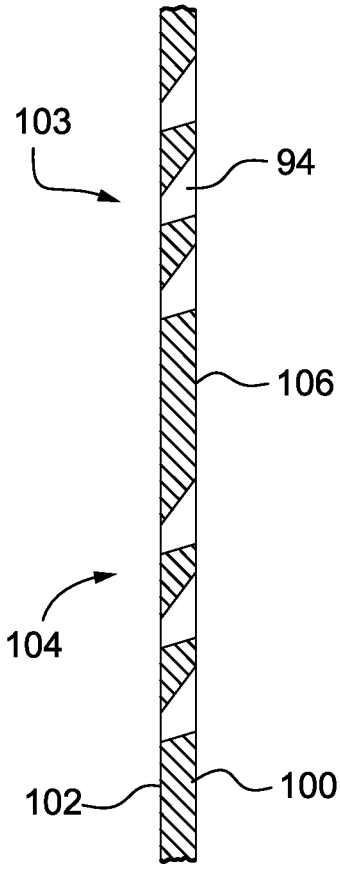
Figure 6:
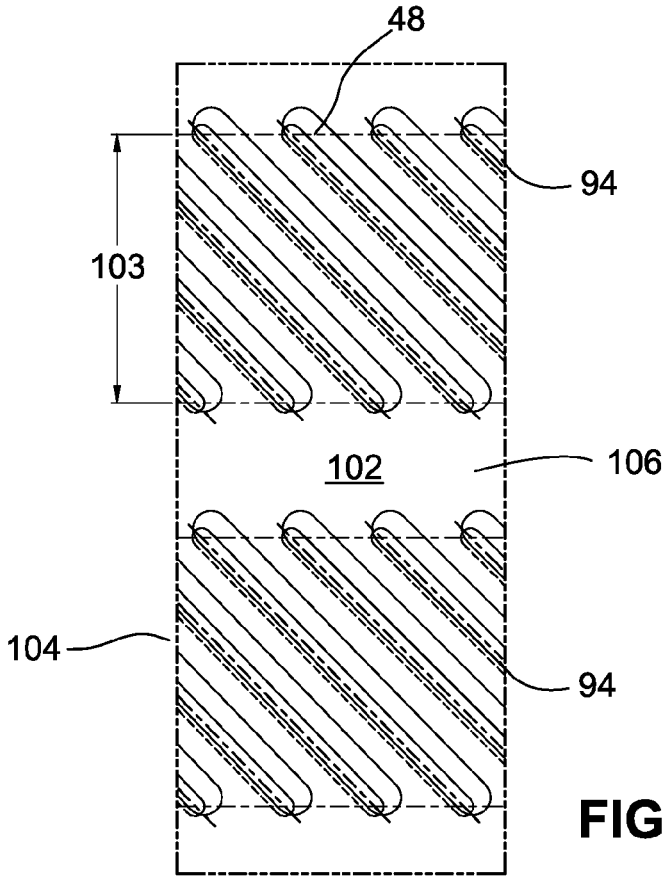

FIGS. 4, 5, and 6 are views of a portion of an outer surface, cross section, and inside surface, respectively, of a screen basket 80. FIG. 5 shows in cross-section the portion marked 5-5 in FIG. 3. FIGS. 4 and 6 are views of the outer and inner surfaces shown in cross-section in FIG. 5.

The inside surface 102 of the screen basket 80 (as shown in FIG. 3) is generally smooth, cylindrical, and includes diagonal rows 103, 104 of shaped slots 94 and solid land surfaces 106 between the diagonal rows 103, 104. The width and spacing of the shaped slots 94 are a function of the expected solid particulate size within the black liquor slurry stream passing through the in-line drainer, and a desired pressure drop through the shaped slots 94. For low-solids concentration black liquor slurry streams, e.g., a black liquor slurry stream having a high ratio of liquor to chips/pins/fines, the width of the slots, at the narrowest portion (throat) of the slot, may be between about 1 to 8 mm and have a length of 5 to 36 mm. Generally, all of the shaped slots 94 in a screen basket have a uniform width. In a row 103, 104 of shaped slots 94, the distance between adjacent side edges of the shaped slots 94 may be about 2 to 7 mm.

The orientation of the shaped slots 94 with respect to the axis of the screen basket may be parallel, perpendicular, or oblique. The orientation of the exemplary shaped slots 94 shown in FIGS. 4 to 7 is 45 degrees.

Figure 7:
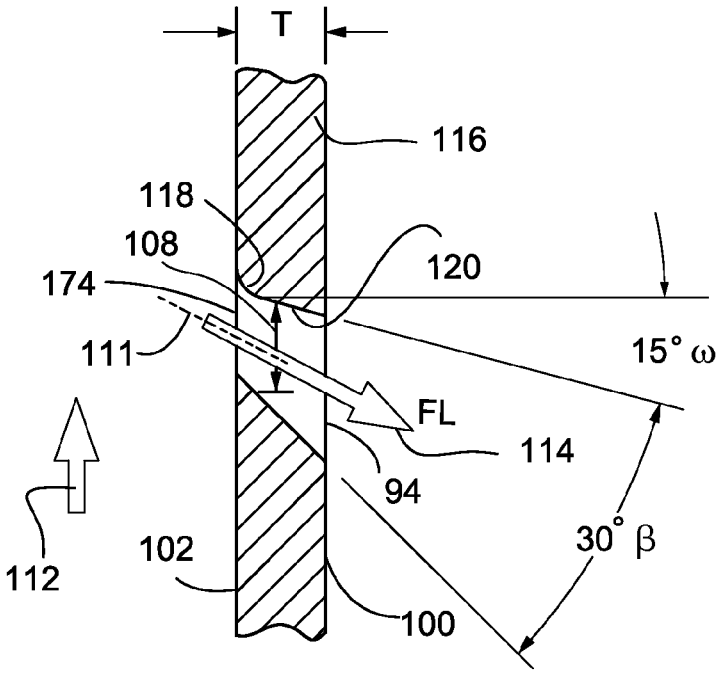
FIG. 7 shows a cross-section of a slot in the screen basket.

As best shown in FIGS. 5 and 7, the shaped slots 94 may be narrow at the inside surface 102 of the screen basket and wide at the outer surface 100. The thickness (T) of the plate 116 may be 4 to 12 mm. The throat 108, which is the narrowest portion of the shaped slot 94, may have a width of 1 mm to 6 mm, such as 2.5 mm. The slots may taper from the inside to outer surfaces of the basket at a relief angle (β) of 5 degrees to 45 degrees, or 5 degrees to 30 degrees, or 5 degrees to 15 degrees.

The axis 111 of each shaped slot 94 may be offset from horizontal at an angle, e.g., 45 degrees, such that the opening of each shaped slot 94 on the inside surface 102 of the screen basket is axially offset from the outlet of the shaped slot 94 on the outer surface 100. This axial offset is such that the outlet of the shaped slot 94 is below the inlet to the shaped slot 94 in the direction of the black liquor slurry stream flow 112 through the screen basket. In view of the axial offset, the direction of liquor flow 114 through the shaped slot 94 has a component opposite to the black liquor slurry stream flow 112 direction. The axial offset of the shaped slots 94 is selected to enhance the effect of movement of the liquor through the shaped slots 94 and to block solids from entering or clogging the shaped slots 94. The axial offset may be at an angle with respect to the axis of the screen basket of 45 degrees or in a range of 40 degrees to 50 degrees or zero degrees (vertical) to 75 degrees. The upper sidewall 120 of each shaped slot 94 may be offset from perpendicular to the plate 116 of the screen basket by an angle (ω) of between 5 degrees to 45 degrees, or 5 degrees to 30 degrees, or 5 degrees to 15 degrees.

FIG. 7 shows the shaped slot 94 having a curved edge 118 along the entirety of the downstream corner of the shaped slot 94. The curved edge 118 is adjacent the inside surface 102 of the plate 116. The curved edge 118 may be just on the upper edge as shown in FIG. 7, on just the lower edges of the shaped slots 94 or on both the upper and lower edges of the shaped slots 94. The edges of the shaped slots 94 at the slot opening 174 may be one or more of rounded, chamfered, sloped or inclined. The curved edge 118 may have a uniform radius of curvature in a range of one-third to two-thirds, e.g., 0.5, of the thickness (T) of the plate 116.

Avoiding sharp angles on the edges of the slots reduces the tendency of solid particulate (wood chips, fines, other cellulosic material, etc.) caught at the edges of the shaped slots 94. For an in-line drainer having an upper inlet, the shaped slots 94 may have a curved edge 118 at the lower edge of the opening of the shaped slot 94. For an in-line drainer having a lower inlet, the curved edge 118 may be at the upper edge of the openings of the shaped slots 94. The curved edge 118 reduces the tendency of the edges of the shaped slots 94 to catch solid particulates (cellulosic material) in the black liquor slurry stream flowing through the in-line drainer. The curved edge 118 on the shaped slot 94 tends to deflect solid particulates into the flow and away from the shaped slot 94.

While the invention has been described in connection with what is presently considered to be the most practical and preferred embodiments, it is to be understood that the invention is not to be limited to the disclosed embodiments, but to the contrary, is intended to cover various modifications and equivalent arrangements, structures, systems, and methods included within the spirit and scope of the appended claims.

What is claimed is:

1. A liquid separator for draining liquid from a moving black liquor slurry stream comprising:

a cylindrical housing having an inlet proximate to a first end of the cylindrical housing, a first outlet proximate to a second end of the cylindrical housing, a second outlet proximate to the first end of the cylindrical housing, and an internal chamber between the inlet and first outlet, wherein the internal chamber extends along an axis of the cylindrical housing;

a screen basket mounted in the internal chamber of the cylindrical housing, the screen basket formed of a plate having side edges which are joined to form a black liquor slurry stream flow chamber, wherein the inlet and first outlet of the cylindrical housing are in fluid communication with the black liquor slurry stream flow chamber;

a liquid collection chamber formed between an outer surface of the screen basket and an inner surface of the cylindrical housing;

the second outlet on the cylindrical housing in fluid communication with the liquid collection chamber;

the screen basket including slots extending through the basket to provide liquid flow passages from the black liquor slurry stream flow chamber to the liquid collection chamber;

said screen slots each having a length substantially greater than a width of the slot, the width of the slots is selected to retain solid particles of the moving black liquor slurry stream within the black liquor slurry stream flow chamber and block the solid particles from entering the liquid collection chamber, and the slots having a length dimension which forms an oblique angle with respect to the axis of the cylindrical housing dimension of between about five degrees to ninety degrees, and the slots each having a curved corner edge adjacent a surface screen basket facing the black liquor slurry stream flow chamber, wherein the slots are arranged in rows on the screen basket, the rows are separated by land surfaces of the screen basket, and in each of the rows the slots in the row all have uniform dimensions, orientations and shapes.

2. The liquid separator of claim 1 wherein each slot has a uniform width of about 1 to 8 mm and a length of about 5 to 36 mm.

3. The liquid separator of claim 1 wherein the oblique angle is in a range of 25 to 35 degrees.

4. The liquid separator of claim 1 wherein the oblique angle is in a range of 35 to 45 degrees.

5. The liquid separator of claim 1 wherein the oblique angle is in a range of 45 to 55.

6. The liquid separator of claim 1 wherein the plate of the screen basket has a thickness (T) and the curved corner edge has a radius of curvature in a range of one-third T to two-thirds T.

7. The liquid separator of claim 1 wherein the curved corner edge is on an edge of the slot downstream of the moving black liquor slurry stream.

8. The liquid separator of claim 1 wherein the curved corner edge is on both side edges of each slot.

9. The liquid separator of claim 1 wherein each slot has a narrowest width between the curved corner edge and an outlet of the slot.

10. The liquid separator of claim 9 wherein the narrowest width of each slot is in a range of 1 mm to 6 mm.

11. The liquid separator of claim 1 wherein the width of each slot is uniform along the length of the slot.

12. The liquid separator of claim 1 wherein each slot tapers from an inlet to an outlet at an angle (β) of 5 degrees to 45 degrees.

13. The liquid separator of claim 1 wherein an axis of each slot is offset from being perpendicular to the axis by an angle in a range of 30 to 55 degrees.

14. The liquid separator of claim 1 wherein an outlet of each slot is axially upstream of an inlet to the slot in the direction of the black liquor stream flow.

15. The liquid separator of claim 1 wherein the curved edge of each slot is at least one of rounded, chamfered, sloped, and inclined.

16. The liquid separator of claim 1 wherein all of the slots are uniform throughout the row in dimensions, orientation and shape.

* * * * *